US009776223B2

(12) United States Patent
Rankin

(10) Patent No.: US 9,776,223 B2
(45) Date of Patent: Oct. 3, 2017

(54) AIR CONTAMINANT SYSTEM WITH LAMINAR FLOW

(71) Applicant: Kelly Rankin, Fort Erie (CA)

(72) Inventor: Kelly Rankin, Fort Erie (CA)

(73) Assignee: Duroair Technologies, Inc., Ontario (CA)

( * ) Notice: Subject to any disclaimer, the term of this patent is extended or adjusted under 35 U.S.C. 154(b) by 996 days.

(21) Appl. No.: 13/771,050

(22) Filed: Feb. 19, 2013

(65) Prior Publication Data

US 2014/0235153 A1 Aug. 21, 2014

(51) Int. Cl.

| | |
|---|---|
| ***B08B 15/02*** | (2006.01) |
| ***E04H 15/14*** | (2006.01) |
| ***E04H 15/52*** | (2006.01) |
| ***F24F 1/02*** | (2011.01) |
| ***F24F 3/16*** | (2006.01) |
| ***F24F 11/08*** | (2006.01) |
| ***B05B 15/12*** | (2006.01) |
| ***E04H 1/12*** | (2006.01) |

(52) U.S. Cl.

CPC ..... *B08B 15/02* (2013.01); *B05B 15/1296* (2013.01); *E04H 1/1277* (2013.01); *E04H 15/14* (2013.01); *E04H 15/52* (2013.01); *F24F 1/02* (2013.01); *F24F 3/1603* (2013.01); *F24F 11/085* (2013.01)

(58) Field of Classification Search

CPC .. B05B 15/1214; B05B 15/1222; Y10S 55/46
USPC ..... 454/50, 63
See application file for complete search history.

(56) References Cited

U.S. PATENT DOCUMENTS

| | | | | | |
|---|---|---|---|---|---|
| 3,265,059 | A | * | 8/1966 | Matthews | 600/21 |
| 3,370,404 | A | | 2/1968 | Leeper | |
| 3,708,963 | A | | 1/1973 | Boonstra et al. | |
| 4,706,551 | A | * | 11/1987 | Schofield | B08B 15/026 135/117 |
| 4,732,592 | A | * | 3/1988 | Spengler | F24F 3/161 55/356 |
| 4,804,392 | A | | 2/1989 | Spengler | |
| 4,850,382 | A | * | 7/1989 | Williams | B05B 13/0431 118/323 |
| 4,932,354 | A | * | 6/1990 | Kistner | 118/305 |
| 5,074,897 | A | | 12/1991 | Sikich | |
| RE33,810 | E | * | 2/1992 | Strieter | 134/99.1 |

(Continued)

FOREIGN PATENT DOCUMENTS

| | | | | |
|---|---|---|---|---|
| DE | 202009005832 U1 | * | 7/2009 | B05B 15/1214 |
| DE | 202009005832 | | 8/2009 | |

(Continued)

*Primary Examiner* — Jonathan Cotov

(74) *Attorney, Agent, or Firm* — Simpson & Simpson, PLLC

(57) ABSTRACT

The present invention is directed toward a movable airborne contaminant control system having a retractable/extendable booth attached in a sealing manner to a ventilation unit, preferably mounted on wheels. The ventilation unit includes a filter assembly that opens into the work are formed by the booth. Front doors support air filters. In operation, the ventilation unit draws air in a longitudinal laminar flow over one or more work pieces. The filter assembly captures both particulates and VOCs to allow the exhaust air to include an extremely low contaminant load.

16 Claims, 9 Drawing Sheets

(56) References Cited

U.S. PATENT DOCUMENTS

| | | | | |
|---|---|---|---|---|
| 5,162,132 | A * | 11/1992 | Diaz | 427/470 |
| 5,173,118 | A * | 12/1992 | Josefsson | B05B 15/1222 118/309 |
| 5,331,991 | A * | 7/1994 | Nilsson | 135/93 |
| 5,558,112 | A * | 9/1996 | Strieter | 134/103.2 |
| 5,922,130 | A * | 7/1999 | Mosser | B05B 15/1222 118/326 |
| 6,383,242 | B1 * | 5/2002 | Rogers et al. | 55/385.2 |
| 6,402,613 | B1 * | 6/2002 | Teagle | 454/195 |
| 6,960,244 | B2 | 11/2005 | Lehman | |
| 6,966,937 | B2 * | 11/2005 | Yachi | A61G 10/005 128/205.26 |
| 7,134,444 | B2 * | 11/2006 | Mintie | B08B 15/00 135/131 |
| 7,188,636 | B1 * | 3/2007 | Kanne et al. | 135/142 |
| 7,377,952 | B2 | 5/2008 | Stout et al. | |
| 7,406,978 | B2 | 8/2008 | Mintie et al. | |
| 7,455,580 | B2 * | 11/2008 | Cheng | 454/50 |
| 7,597,111 | B2 * | 10/2009 | Bauer | 135/96 |
| 2005/0153649 | A1 * | 7/2005 | Bettridge et al. | 454/188 |
| 2006/0243202 | A1 * | 11/2006 | Thelen | B01D 46/0036 118/326 |
| 2007/0095279 | A1 * | 5/2007 | Langeman | 118/326 |
| 2008/0184889 | A1 * | 8/2008 | Zimmerman | 95/286 |
| 2009/0253360 | A1 * | 10/2009 | Tafoya | 454/50 |
| 2010/0272915 | A1 * | 10/2010 | Laws | 427/421.1 |

FOREIGN PATENT DOCUMENTS

| | | |
|---|---|---|
| EP | 0016698 | 10/1980 |
| EP | 0309275 | 7/1991 |
| FR | 7800443 | 8/1979 |
| JP | 2006299736 | 11/2006 |
| WO | 89/02787 | 4/1989 |
| WO | 2007136721 | 11/2007 |

* cited by examiner

AIR CONTAMINANT SYSTEM WITH LAMINAR FLOW

FIELD OF THE INVENTION

The present invention pertains to devices for controlling airborne contaminants, specifically to contaminants generated during servicing operations within a building, and more specifically to containment of airborne contaminants generated within an enclosed environment.

BACKGROUND OF THE INVENTION

The generation of airborne contaminants generated during cleaning, coating, refurbishing and similar operations is often accompanied by the necessity of controlling the contaminants to reduce or eliminate damage to the environment and to not compromise the safety of workers operating in the operational environment. Often these needs are met by the construction of complex systems that filter or divert contaminants to waste collection points for removal offsite. In other cases, complex systems filter contaminants which are then expelled through ducts or stacks to the outside of the environment. In some situations, operations are required to be performed outside buildings to be sure contaminant concentrations do not reach beyond governmental safety limits. These solutions are often expensive and require permanent locations, thus requiring the movement of the items ("work pieces") to be cleaned or otherwise treated to be moved to a separate cleaning facility.

In addition, numerous factories and fabrication facilities manufacture more than one type of item. Often, these items may vary in size and the actual location in the facility where they are manufactured and/or conditioned, e.g. cleaned or painted, may be different for different products. Thus, it would be beneficial to utilize a contaminant control system that could be moved to different locations, sized for different needs, and not require complex ducting or waste treating components to safely contain or remove the airborne contaminates generated during the treatment process.

Finally, workers are often needed to perform the work of cleaning, refurbishing, etc. the various work pieces. It is desirable to reduce or eliminate worker exposure to particulates generated from the work piece and cleaning materials during these operations.

There have been previous attempts to create contaminant control systems that are safe for workers, do not harm the environment, and are efficient to use. U.S. Pat. No. 7,134,444 to Mintie, et al. discloses a portable and collapsible environmental containment unit that includes a HEPA filter intake unit and vacuum to draw intake down and out of the unit to create negative pressure within the collapsible containment unit. However, workers within the unit are exposed to any contaminants that are generated. In addition, contaminants are drawn into a closed container that require disposal.

U.S. Pat. No. 3,370,404 to Leeper discloses an air cleaner the can be attached to the doors of an automobile paint booth. The cleaner is not mobile and utilizes a bent air passage with several inclined fins to create a zigzag course for incoming air through a water filter. However, the air cleaner makes no provision for control of contaminants generated within the attached paint booth itself.

European Patent No. 0016698 to Budzinski shows a paint booth that utilizes a laminar flow air stream to surrounds the work piece being painted and form a circulation around the work piece. The air is exhausted downward through ducts underneath the booth. However, ducts are required to remove the exhaust from the workplace and the '698 patent makes no provision for utilizing the disclosed system with work pieces of different sizes or numbers.

Therefore, there exists in the field a need for a mobile airborne contaminant control system that can be moved to various locations with a facility, provide a safe environment for people working within the contaminant control system, and reduce or eliminate the amount of contaminated effluent air exiting the system.

SUMMARY OF THE INVENTION

The present invention broadly comprises a mobile airborne contamination control system comprising: a ventilation unit having at least one exhaust; a filter assembly housed within the ventilation unit; and a retractable contamination control booth. The retractable contamination control booth includes a retractable/extendable frame having a plurality of pairs of opposing of risers, each riser having a supporting rolling means, wherein each riser in each of the pair of opposing risers is hingeably attached to each adjacent riser; a flexible material draped over all of the opposing risers and thereby covering the retractable frame; a rear wall attached to the flexible material and sealingly attached to the ventilation unit around the filter assembly, wherein the filter assembly opens into the retractable booth from the rear wall; and, a front wall having at least one door, each of the at least one door having a section permeable to air flow.

In a preferred embodiment, the ventilation unit creates an air flow from outside the filtered permeable section of the front door(s) through the retractable booth and into the filter assembly. In a more preferred embodiment, the air flow is a laminar air flow over a particular work piece.

One object of the invention is to supply a mobile airborne contaminant control system that is movable to various locations.

A second object of the invention is to provide a system in which the filtered air leaving the ventilation unit contains airborne contaminants at a level below accepted maximum safety limits.

A third object of the invention is to disclose an airborne contaminant control system that provides a safe environment for workers.

BRIEF DESCRIPTION OF THE SEVERAL VIEWS OF THE DRAWINGS

The nature and mode of the operation of the present invention will now be more fully described in the following detailed description of the invention taken with the accompanying drawing Figures, in which.

DETAILED DESCRIPTION OF EMBODIMENTS OF THE INVENTION

At the outset, it should be appreciated that like drawing numbers on different drawing views identify identical structural elements of the invention. It also should be appreciated that figure proportions and angles are not always to scale in order to clearly portray the attributes of the present invention.

While the present invention is described with respect to what is presently considered to be the preferred embodiments, it is understood that the invention is not limited to the disclosed embodiments. The present invention is intended to cover various modifications and equivalent arrangements included within the spirit and scope of the appended claims.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that the term "substantially" is synonymous with terms such as "nearly", "very nearly", "about", "approximately", "around", "bordering on", "close to", "essentially", "in the neighborhood of", "in the vicinity of", etc., and such terms may be used interchangeably as appearing in the specification and claims. It should be appreciated that the term "proximate" is synonymous with terms such as "nearby", "close", "adjacent", "neighboring", "immediate", "adjoining", etc., and such terms may be used interchangeably as appearing in the specification and claims. Although any methods, devices or materials similar or equivalent to those described herein can be used in the practice or testing of the invention, the preferred methods, devices, and materials are now described.

Figure 1:
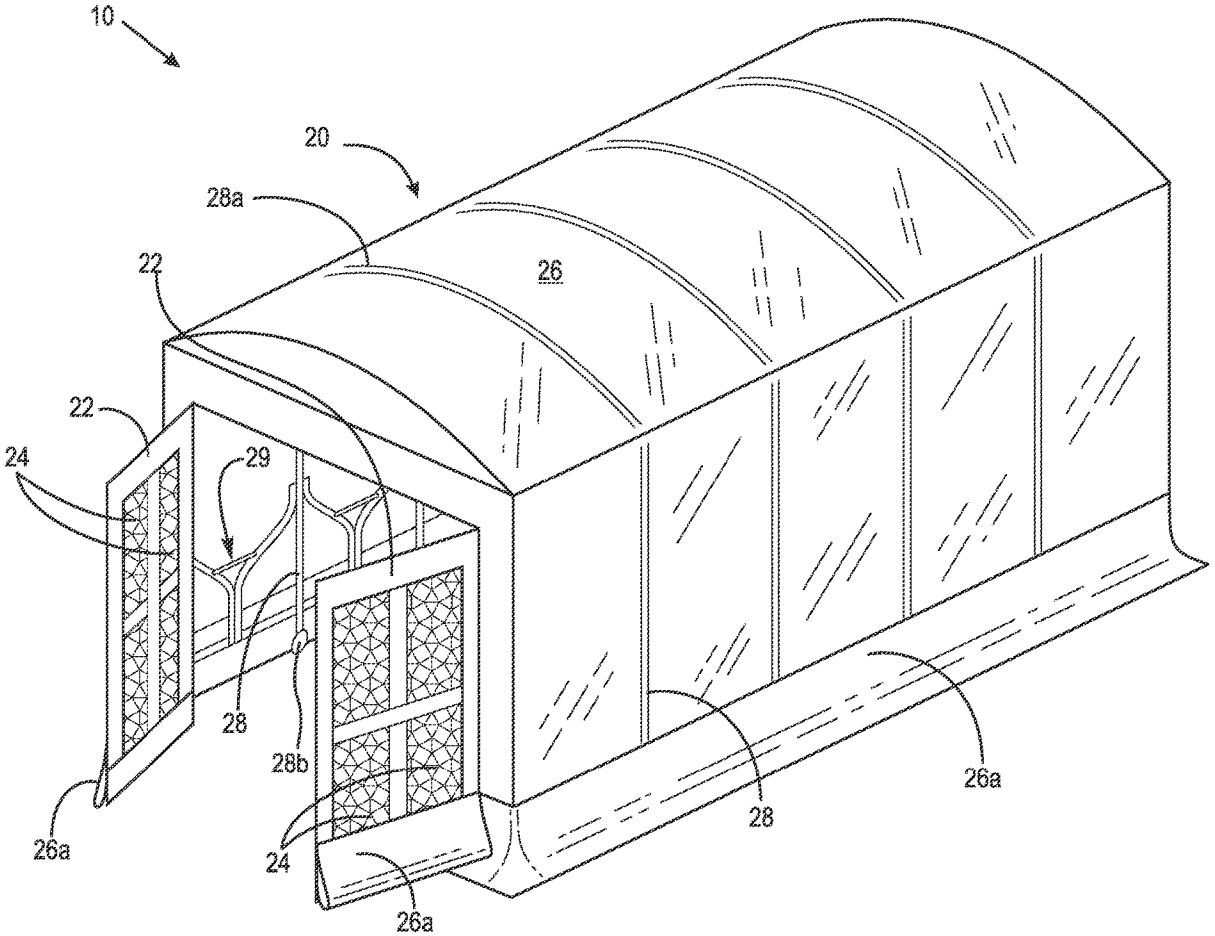
FIG. 1 is a top perspective view of the mobile airborne contamination control system ("system") of the present invention.

Adverting to the drawings, FIG. 1 is a top perspective view mobile airborne contamination control system 10 ("system 10") of the present invention with retractable booth 20 (booth 20") in the extended position. Also seen are opened front doors 22. In the embodiment shown, open front doors 22 each have air permeable sections which can support filters 24 which act as intake air filters as described below. The front opening is sufficiently large to allow a work piece(s) to be moved inside booth 20. Booth 20 includes covering 26, which preferably is a flexible material such as vinyl, polyethylene, canvas, or similar suitable material that is able to maintain its integrity when booth 20 is retracted. Cover 26 is supported by a at least three opposed paired vertical supports or risers 28. Each pair of risers supports a beam or joist 28*a* which bears cover 26. Each one of the pairs of risers 28 is supported on the floor or ground by rolling means 28*b*. Examples of rolling means 28*b* may include wheels, casters, rollers, and other similar devices well known to those having skill in the art. Adjacent pairs of support risers 28 are attached by hinged assembly 29. As will be described below, hinge assembly 29 is pivotable or otherwise movable and connects adjacent support risers 28 while booth 20 is stationary in the extended and retracted positions as well as when it is being extended or retracted longitudinally. By longitudinally is meant booth 20 is retracted and expanded in a direction from front doors 22 and rear wall 40.

Figure 2:
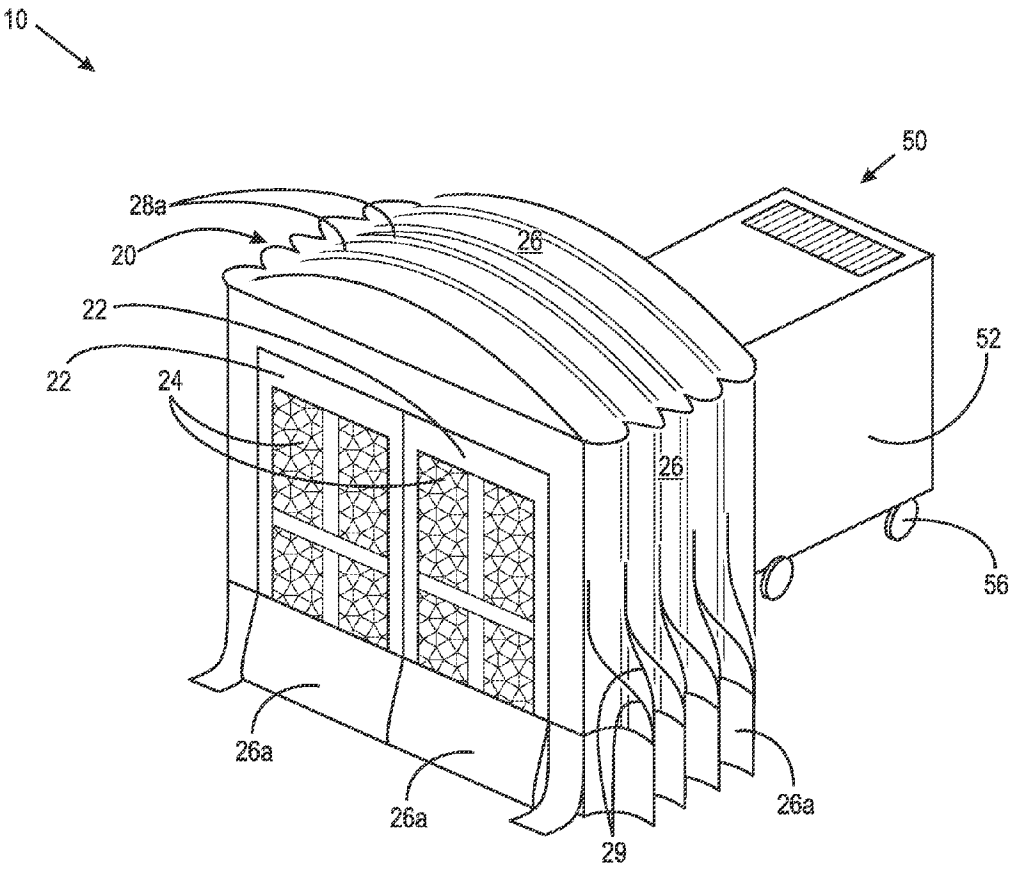
FIG. 2 is a top perspective view of the system in the retracted position.

FIG. 2 is a top perspective view of system 10 in the retracted position. It can be seen that cover 26 has sufficient flexibility to be folded when booth 20 is pulled in. Also seen is ventilation unit 50 ("unit 50") having housing 52 with at least one exhaust 54. In the embodiment shown, unit 50 may be mounted on wheels, casters, or other similar devices that enable unit 50 to be moved to different locations with the other components of system 10. Hinge assemblies 29 are seen projecting outward which allows fold 26*a* to be lifted off the supporting floor allowing booth 20 to be moved more easily.

Figure 3:
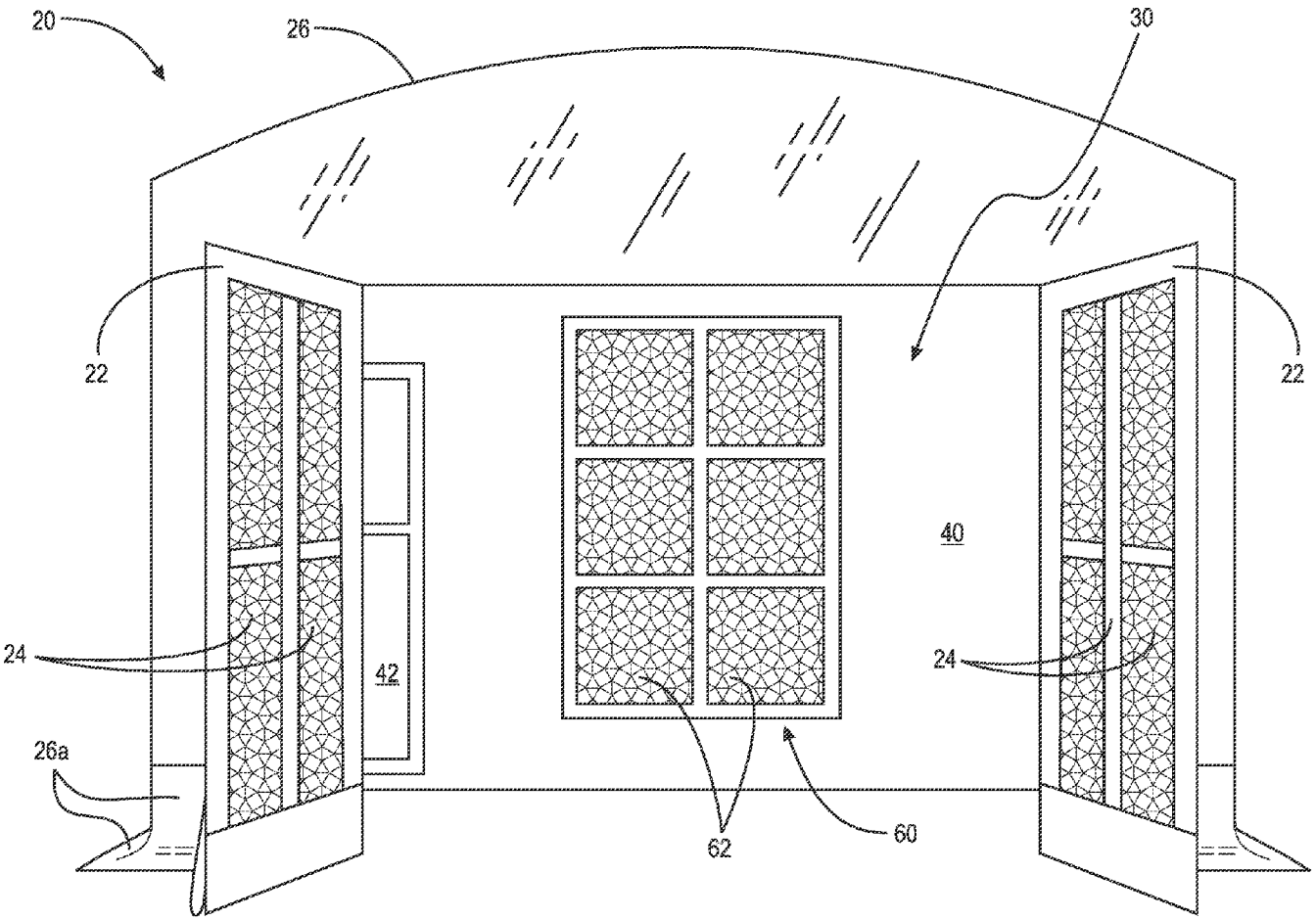
FIG. 3 is a front view of the interior of the system in which the booth is extended and the front doors hold filters and are open.

FIG. 3 is a front view of system 10 in which booth 20 is extended and front doors 22 are open. Booth 20 encloses work area 30. Rear wall 40 forms the back wall of booth 20 opposite front doors 22 and is attached to the rearmost pair of risers 28 farthest from front door 22 to form an air tight connection between rear wall 40 and cover 26. In a preferred embodiment, rear wall 40 encloses rear door 42, which may be sized to allow personnel to easily enter and exit work area 30 from the back of booth 20. Preferably, rear wall 40 is flexible and fabricated from material similar to the flexible material used for cover 26.

Filter assembly 60 is supported by rear wall 40 and includes a plurality of filters 62. Filter assembly 60 is aligned longitudinally with filters 24 of front doors 22 with the area of the front face of filter assembly 60 sized to be smaller than the area of front filters 24.

Figure 4A:
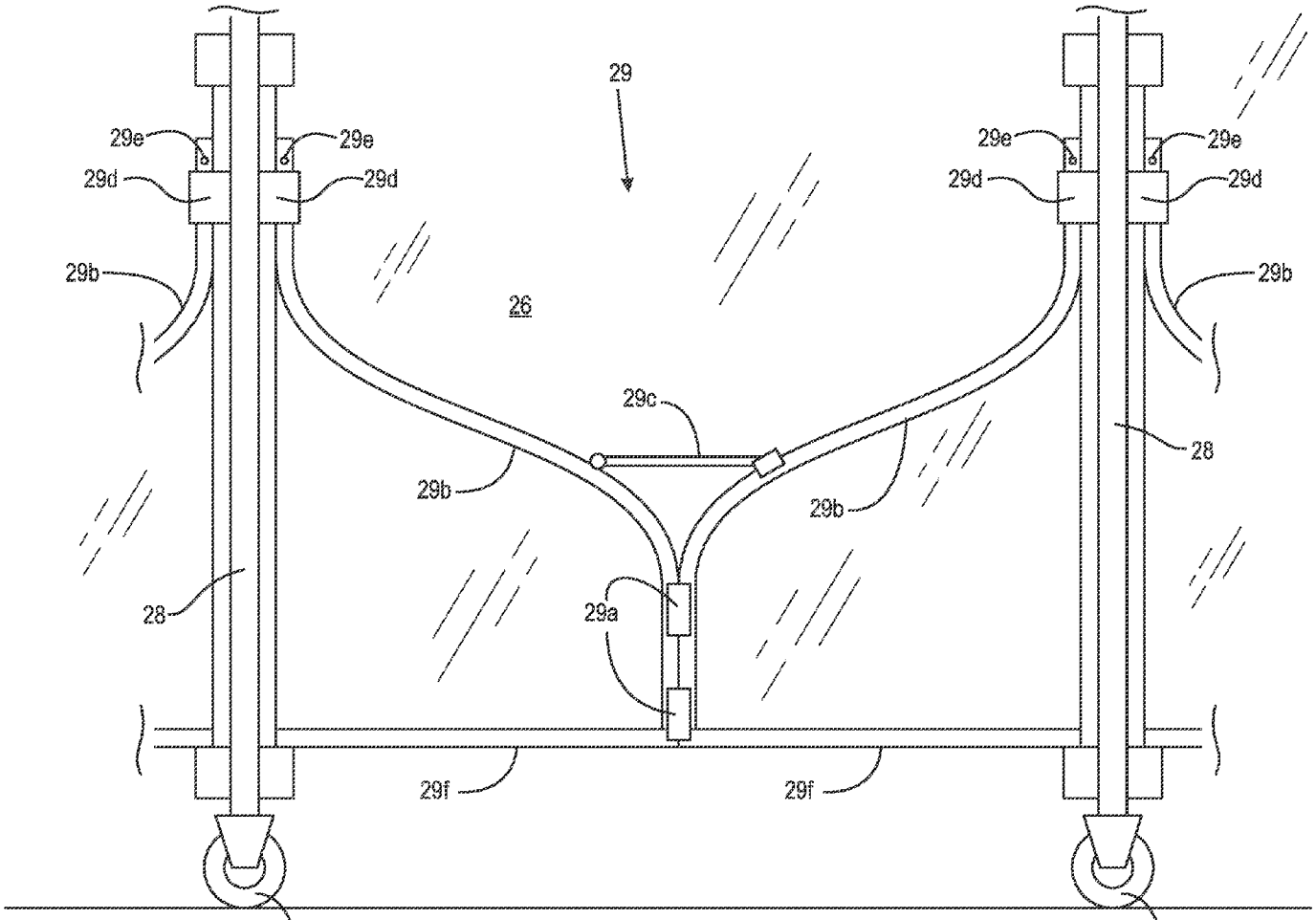
FIG. 4A is a close up view of the hinged attachment between adjacent support risers in the open or locked with the retractable/extendable booth in the extended position.

FIG. 4 is a close up view of hinge assembly 29 supporting adjacent members of adjacent pairs of risers 28 in the open or locked position with booth 20 extended. A pair of hinge arms 29*b* are each formed as a curved y-shaped arm joined in the "leg" portion by hinges 29*a*. Hinges 29*a* are mounted on the inner side of hinge assembly 29 inside work area 30. In one embodiment, hinge arms 29*a* are round tubes formed into the shape shown. Hinge arms 29*b* are each inserted into cuffs 29*d* which are attached to risers 28 and are larger than hinge arms 29*b*, e.g., hinge arms 29*b* with diameter of ¾ inch is inserted into cuff 29*d* with a cross section width of 1 inch. Cuffs 29*d* hold hinge arm 29*b* in functional connection with riser 28 to allow risers 28 to move as hinge assembly is opened and closed. By functional attachment is meant that the link between hinge arm 29*b* and cuff 29*d*, fixedly attached to riser 28, allows the components to function by allowing risers 28 to move toward and away from work area 30 as hinge assembly 29 is opened and folded. Pin 29*e* extends through hinge arm 29*b* and prevents hinge arm 29*b* from falling through cuff 29*d* if the floor or other supporting surface is uneven. Cross piece 29*c* is attached to one of arms 29*b* by a nut and bolt assembly and is locked onto the opposing hinge arm 29*b* to maintain the rigid open position of hinge assembly 29*a*. Also seen are wheels 28*b* acting as supporting rolling means for risers 28.

Figure 4B:
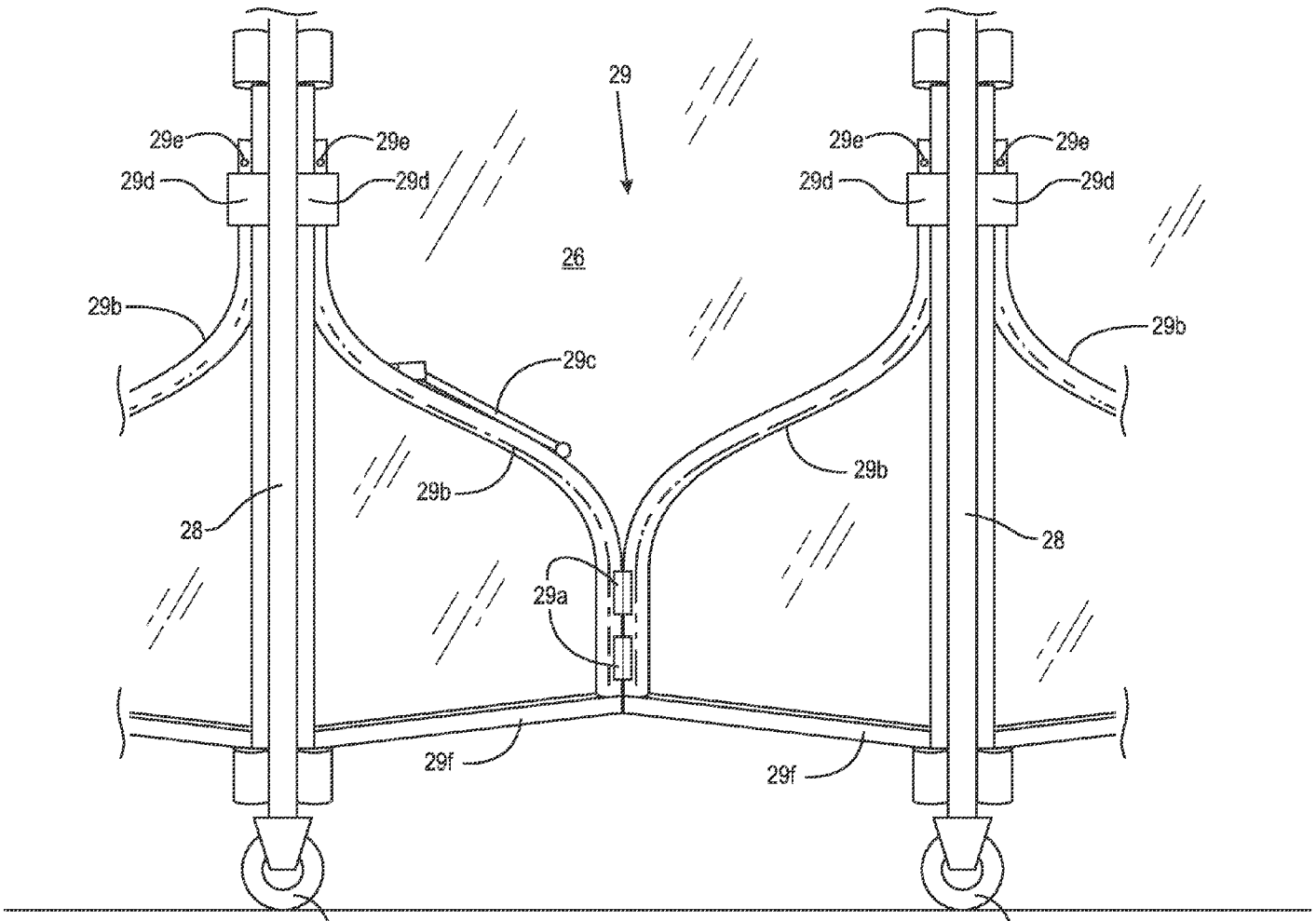
FIG. 4B is a close up view of the hinged attachment between adjacent support risers in the folded or unlocked position allowing the booth to be retracted.

FIG. 4B depicts hinge assembly 29*a* in the folded or closed position. It can be seen that cross piece 29*c* is seen unlocked and folded back onto one of hinge arms 29*b*. It is evident that as hinges 29*a* are closed, hinge arms 29*b* are moved closer to each other bringing risers 28 closer to each other. When all of hinge assemblies are unlocked, the entire booth 20 may be retracted toward ventilation unit 50 as seen in FIG. 2.

Figure 5:
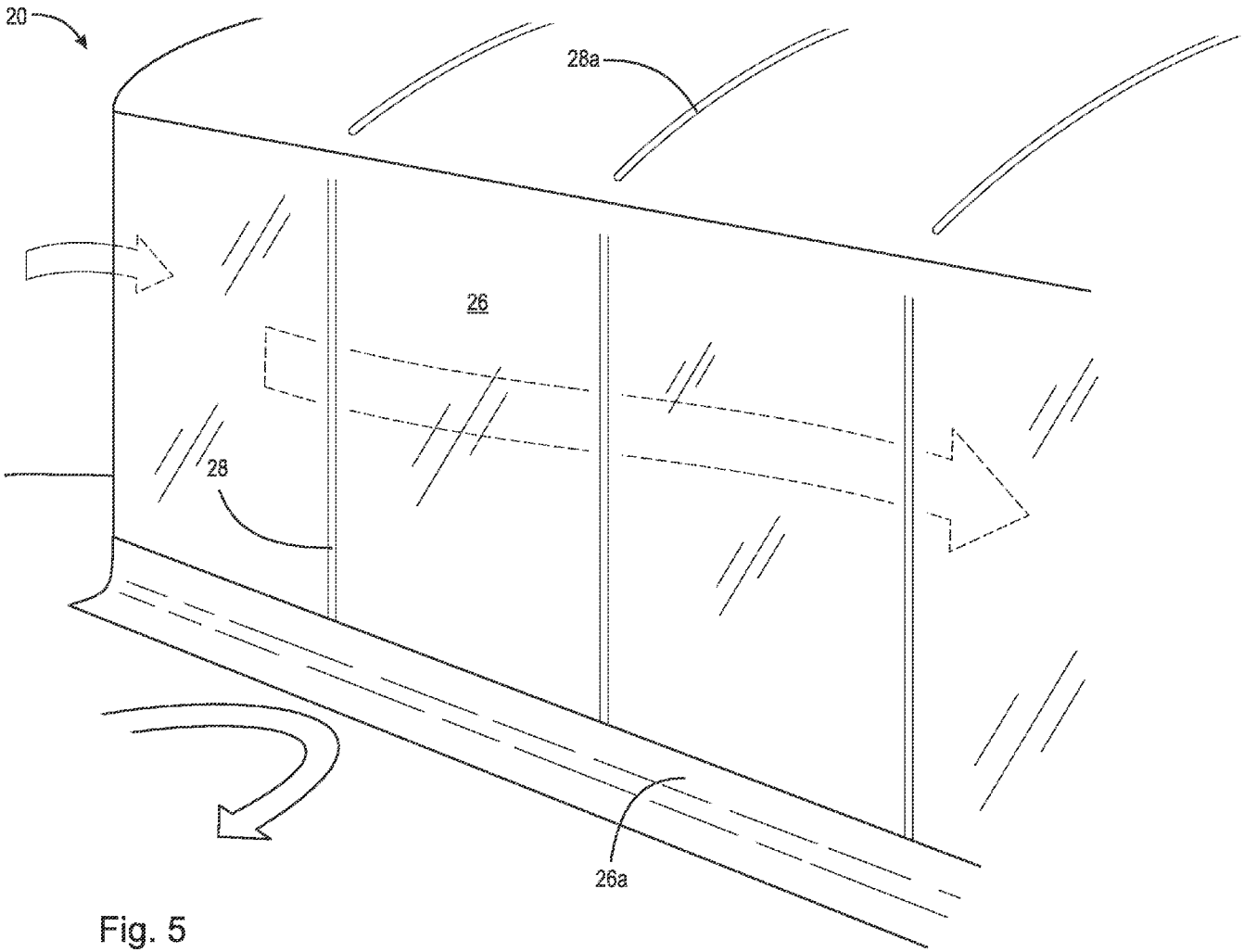
FIG. 5 is a side perspective view of the outside of the retractable booth showing the sealing arrangement used to prevent leaks into and out from the booth from between the floor and the bottom of the cover when the system is operating.

FIG. 5 is a side view of the outside of booth 20 showing the sealing arrangement to seal cover 26 to prevent leaks of the laminar flow from between the floor and the bottom of cover 26. Fold 26*a* extends from cover 26 onto the floor or other supporting surface around the perimeter of booth 20. Preferably the portion of fold 26*a* on front door(s) 22 may be folded up and held against front door(s) 22 to enable doors 22 to be opened and closed without interference from fold 26*a*. Fold 26*a* may comprise separate sections attached to different lengths and widths of booth 20 with the different sections overlapping or otherwise arranged to prevent leaks. The shaded arrows show the movement of air inside booth 20 when exhaust fan 53 is turned on. The outside arrow shows the seal formed by the negative pressure created by exhaust fan 53, which acts to tightly hold fold 26*a* against the floor, prevents outside air from entering work area 30 from between the floor and the bottom edge of cover 26. When hinge assembly 29 is unlocked and folded back, arms 29*b* are folded outward and act to pull fold 26*a* off the floor as cover 26 rides up each of the hinge arms 29*b* as seen in FIG. 2.

Figure 6:
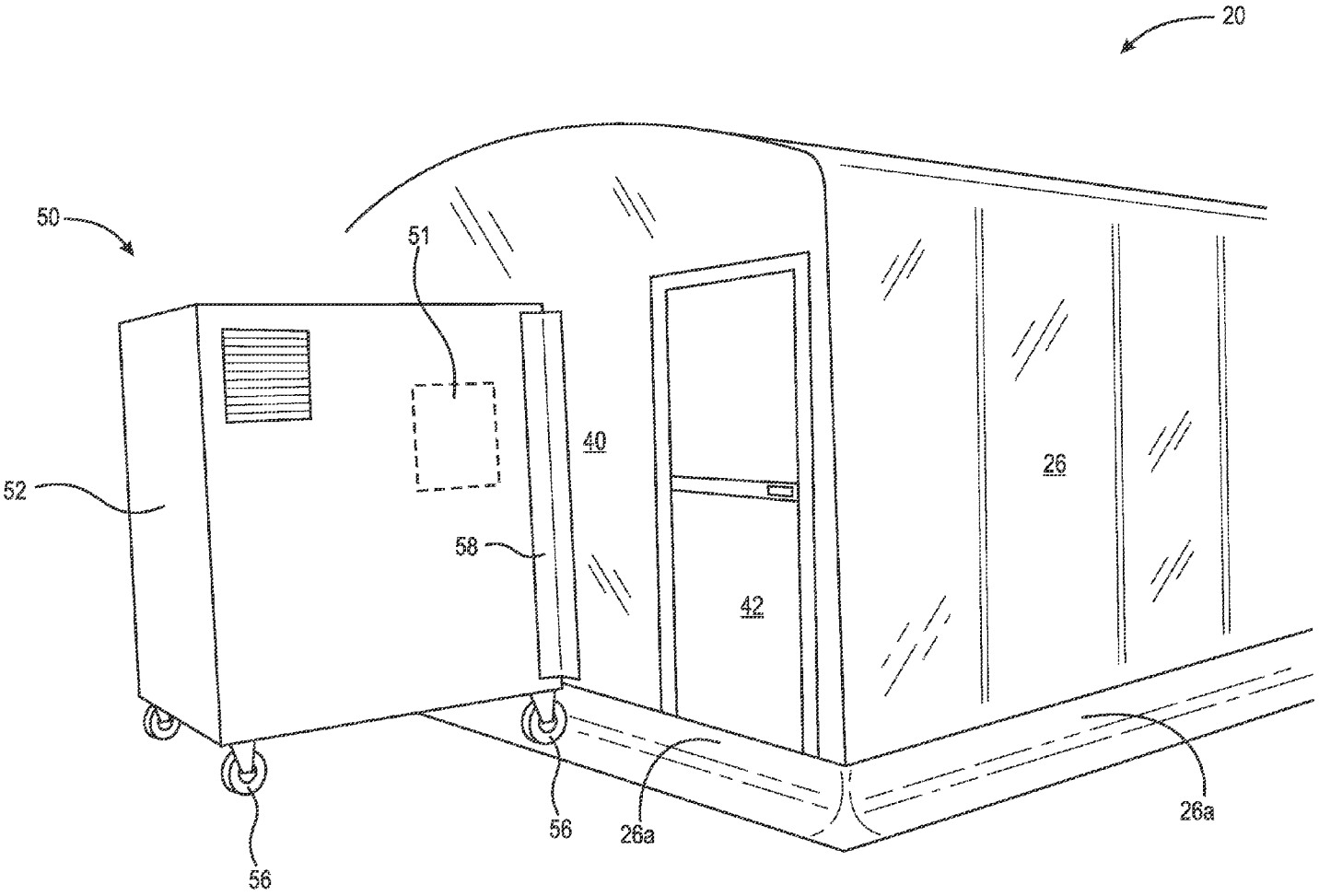
FIG. 6 is a rear perspective view of the mobile airborne contamination control system that depicts the mobile ventilation unit sealed against the rear wall of the retractable booth.

FIG. 6 is a rear perspective view of system 10 that includes ventilation unit 50. Housing 52 is supported by wheels 56 allowing it to be moved to any particular desired location. Unit 50 is sealed against rear wall 40 by seal 58 which extends around the complete perimeter of the input side (not shown) of unit 50. Electrical box 51 is shown shaded inside housing 52 and contains the electrical circuitry of unit 50.

Figure 7:
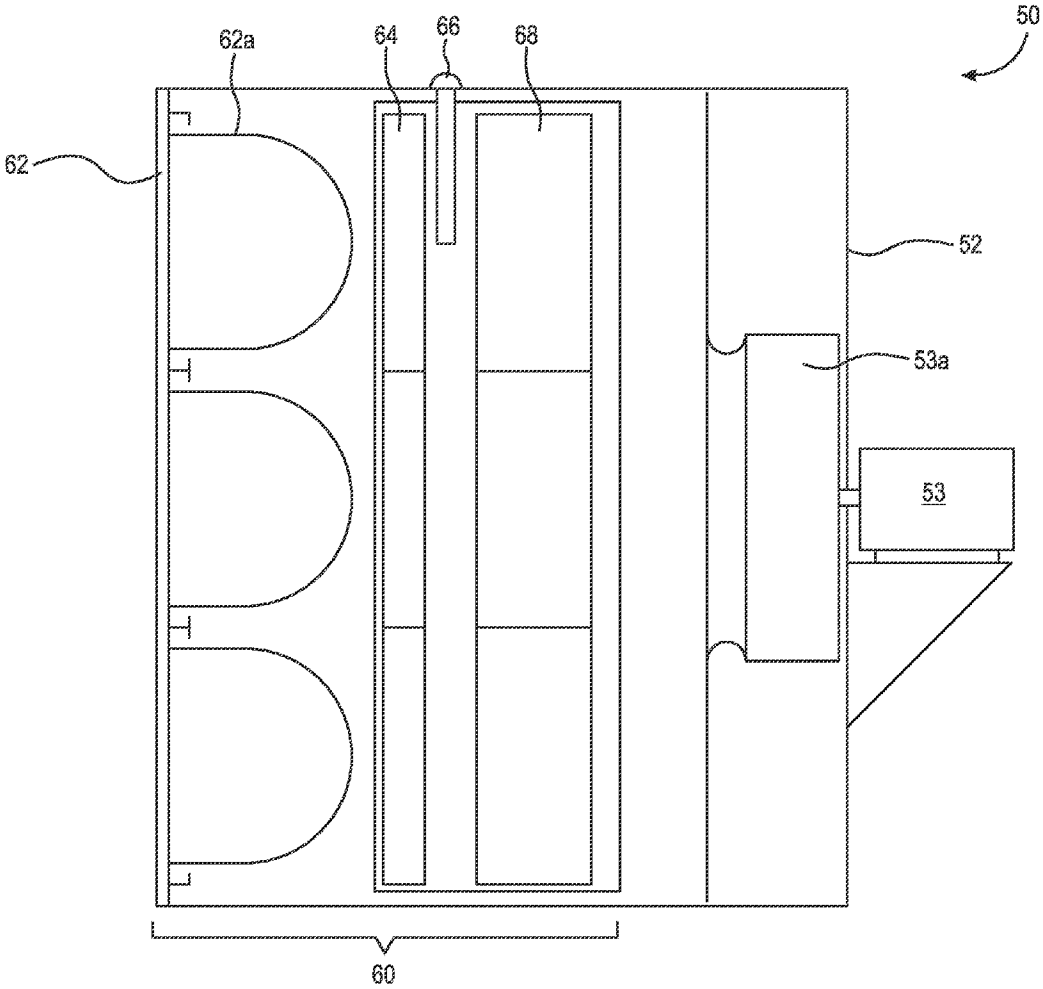
FIG. 7 is schematic side view of filter assembly 60 positioned in the ventilation unit; and, FIG. 8 is a schematic top view of system 10 with the top portion of the retractable booth removed.

FIG. 7 is schematic side view of filter assembly 60 positioned in ventilation unit 50. The arrow indicates the incoming flow of air from work area 30. Filter 62 is a first dust filter capable of filtering particles having a size of 0.62 microns or greater. Preferably the filter is constructed to be loaded in depth. A suitable filter is Tri-Dek Model 3/67 manufactured by Tri-Dim Filter Corporation of Louisa, Va. 23093 or filters of similar construction having at least a two ply panel. In the embodiment shown in FIG. 3, six panels are arranged in a 2×3 pattern. However, other arrangements may be used depending on the desired capabilities of system 10.

Filter 62*a* is second dust filter, preferably utilizing organic synthetic fibers that are nonshedding and designed to hold particles in depth. In a preferred embodiment, each filter 62*a* includes a self-supporting pocket that maintains filter structure in the airstream. A suitable filter is the Viledon Model f45s manufactured by Freudenberg Filtration Technologies LP of Hopkinsville, Ky. 42240. Six filters 62*a* fit behind the six filters 62.

Filter 64 is an activated carbon filter used to capture volatile organic carbons (VOCs). Preferably, filter 64 also captures additional particles not captured by filters 62 and 62*a*. A typical filter is the Viledon CP/DP DualPleat Filter by Freudenberg. In the embodiment shown, filter assembly 60 includes six filters 64 arranged in a 2×6 configuration directly behind filter 62*a*.

The fourth filter stage of filter assembly 60 is a pair of UV light sanitizers 66 utilized as air sanitizers designed to reduce carbon-based contaminants, such as mold, bacteria, viruses, odors and volatile organic compounds. Although only on UV sanitizers 66 is shown in the side view of FIG. 7, preferably a pair of UV sanitizers is inserted through the top of filter assembly 60. Persons of skill in the art will recognize that the number of sanitizers 66 to be used will depend on the size of filter assembly 60, the speed of the air stream and other factors recognized by persons having skill in the art. A suitable UV sanitizer is the Air Oasis Nano HCT 14" Induct by Air Oasis, Amarillo, Tex. 79118.

Filter 68 is a gas phase filter with activated carbon designed to capture VOCs and ozone from the air stream. Similar to the filter components discussed above, filter 68 is preferably arranged in a 2×3 configuration with each separate filter component aligned behind corresponding filters 62, 62*a*, and 64 which are also aligned in a 2×3 configuration as discussed above. Persons of skill in the art will recognize that other configurations of the filter stages may be suitable depending on the airstream, size of work piece(s) and size of booth 20 and unit 50 among other variables.

Also seen in FIG. 7 is at least one fan motor 53 and fan wheel 53*a* used to draw air through work area 30 and through filter assembly. In one embodiment, fan motor 53 is a 10 horse electric motor and fan wheel 53*a* a 30 inch diameter wheel. Persons of skill in the art will recognize that different motor and fan sizes can be used based on the size of work area 30.

Figure 8:
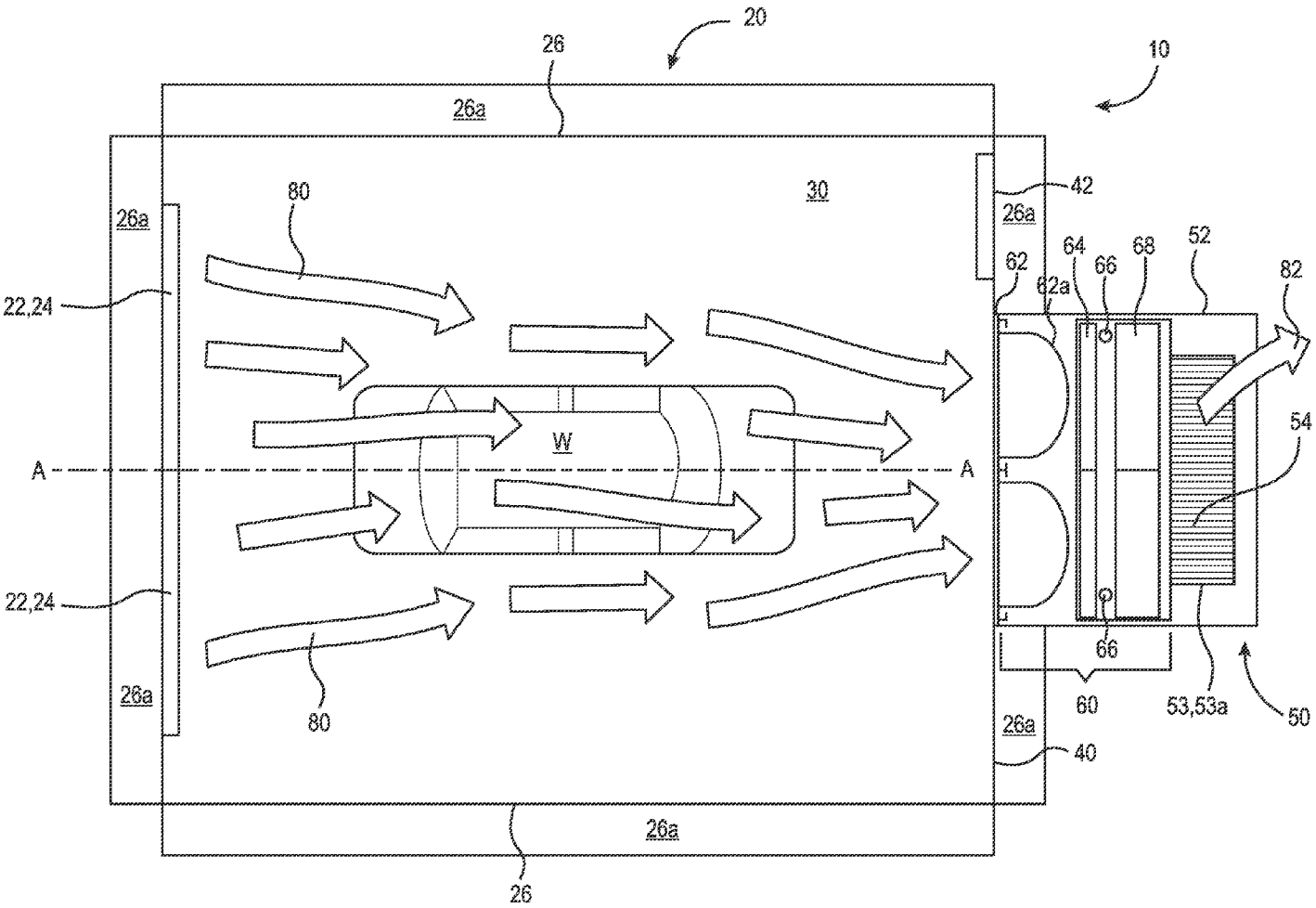

FIG. 8 is a schematic top view of system 10 with the top portion of booth 20 removed for clarity. Work piece W is seen placed in work are 30. Front filters 24 are in doors 22 and longitudinally aligned with the opening into filter assembly 60 within rear wall 40. By longitudinally aligned is meant that the center of the total filter area of all front filters 24 is aligned with the center of filter assembly 60 along the center axis A of booth 20. It can be seen that the total area of filters 24 is greater than the total area of the opening into filter assembly 60. In the embodiment shown, one 30 inch reverse incline fan 53*a* with 10 hp exhaust fan motor 53 (not shown in FIG. 8) is used with exhaust grate 54. Preferably, a single exhaust grate 54 is used with one or more exhaust fans 53. When ventilation unit 50 is turned on, exhaust fans 53 draw airstream 80 from outside booth 20 through front filters 24 over work piece W in a laminar airflow 80. By laminar flow is meant that the air flow does not disperse throughout booth 20 but remains within the volume of work area 30 that extends in tapered fashion from the bounds of front filters 24 to the opening of filter assembly 60 as shown in FIG. 8. By placing work piece W within laminar airstream 80, any particulates. VOCs, and other contaminants, such as generated by painting, sanding, coating, sand-blasting, etc., will be confined to airstream 80 and carried to filter assembly where the contaminants are trapped. Workers may work outside the airstream and not be affected by contaminants generated by the work. Exhaust air is shown as air flow 82 exiting from exhaust grate 54.

In addition, it has been found that use of filter assembly 60 constructed as described above prevents any meaningful quantity of contaminants from exiting unit 50 after passing through filter assembly 60. Table 1 shows test results measuring the exposure outside system 10 to contaminants during painting operations taking place within booth 20.

TABLE 1

| Event | Contaminant | Maximum | Average | Minimum | Exposure Limits |
|---|---|---|---|---|---|
| Before Spray Painting | Particulate ($mg/m^3$) | 0.041 | 0.019 | 0.011 | 10 $mg/m^3$ |
| During Spray Painting | | 0.026 | 0.018 | 0.011 | |
| After Spray Painting | | 0.024 | 0.013 | 0.001 | |
| Before Spray Painting | CO (ppm) | 0 | 0 | 0 | 25 ppm |
| During Spray Painting | | 0 | 0 | 0 | |
| After Spray Painting | | 0.22 | 0 | 0 | |

Table 2 shows that system 10 effectively captures VOCs during a spray painting operation.

TABLE 2

| Volatile Detected | Before Spray Painting (ppm) | During Spray Painting | After Spray Painting | Occupational Exposure Limit (ppm) |
|---|---|---|---|---|
| Acetone | 0.48 | 2.19 | 1.43 | 500 |
| Toluene | 0.00198 | 0.0071 | 0.0056 | 20 |
| o-xylene | 0.008 | 0.00293 | 0.00205 | 100 |

It can be seen that system 10 provides the advantage of being used inside a building without the need of ductwork directing the outflow of air from unit 50 to the outside of the building. In addition, unit 50 may be used as a stand-alone unit without exhaust ducts or an attached booth, such as booth 20. In such an independent mode, unit 50 may be placed in a work area, such as a stable, dusty work area, etc. and operated to intake air within the room and exhaust clean, filtered air back into the same room or work area. As seen from the above test results, the particulates, VOCs, and other contaminants will be caught in filter assembly 60, thereby cleaning the air.

Thus it is seen that the objects of the invention are efficiently obtained, although changes and modifications to the invention should be readily apparent to those having ordinary skill in the art, which changes would not depart from the spirit and scope of the invention as claimed.

What is claimed is:

1. A mobile airborne contamination control system comprising:

a ventilation unit having at least one exhaust fan;

a filter assembly housed within said ventilation unit; and, a retractable contamination control booth including:

a longitudinally retractable/extendable frame having at least three pairs of opposing of risers, each said riser having a supporting rolling means, wherein each riser in each of said pair of opposing risers is hingeably attached to each adjacent riser;

at least three joists, each one of said at least three joists attached to one pair of said at least three pairs of opposing risers;

a cover of flexible material draped over all of said opposing risers and joists and thereby covering said retractable frame to form said booth having an enclosed work area;

a flexible rear wall attached to said retractable/extendable frame and sealingly attached to said ventilation unit around said filter assembly, wherein said filter assembly opens into said retractable booth from said rear wall; and, a front wall of said booth having at least one front door, each of said at least one door having a section permeable to air flow;

wherein said permeable section includes air intake filters;

wherein said cover of said mobile airborne contamination control system is configured to be draped over the exterior of said frame in said longitudinally retracted condition; and wherein said at least one permeable section is longitudinally aligned with said filter assembly and wherein the total area of said at least one permeable section is larger than the total area of said opening of said filter assembly.

2. The mobile airborne contamination control system as recited in claim 1 wherein said at least one front door is two front doors.

3. The mobile airborne contamination control system as recited in claim 1 wherein said filter assembly includes at least one particle filter and at least one carbon filter.

4. The mobile airborne contamination control system as recited in claim 1 wherein said filter assembly comprises:

a plurality of particle filters exposed to said interior, wherein one of said at least one particle filters is a HEPA filter; and, an activated carbon filter.

5. The mobile airborne contamination control system as recited in claim 4 further comprising at least one UV light.

6. The mobile airborne contamination control system as recited in claim 1 wherein said flexible cover includes one or more folds, wherein said one or more folds extend onto said supporting surface and form a seal against a supporting surface.

7. The mobile airborne contamination control system as recited in claim 6 wherein said one or more folds extend around the whole bottom perimeter of said booth.

8. The mobile airborne contamination control system as recited in claim 1 wherein said rear wall includes a door.

9. The mobile airborne contamination control system as recited in claim 1 wherein said at least one exhaust fan draws an airstream into said work area through said at least one permeable section and into said filter assembly wherein said airstream is in a longitudinal laminar flow.

10. The mobile airborne contamination control system as recited in claim 9 wherein said longitudinal laminar flow is directed over one or more work pieces.

11. The mobile airborne contamination control system as recited in claim 1 wherein said at least one exhaust fan is a single fan.

12. The mobile airborne contamination control system as recited in claim 1 wherein said at least one exhaust fan is two exhaust fans.

13. The mobile airborne contamination control system as recited in claim 1 wherein said ventilation unit is mounted on wheels.

14. The mobile airborne contamination control system as recited in claim 1 wherein said hinged attachment is formed by a hinge assembly having hinges, said hinges mounted on the inside of said retractable booth.

15. The mobile airborne contamination control system as recited in claim 14 wherein said hinge assembly further comprises two opposing hinge arms, each of said opposing hinge arms mounted on adjacent risers, and a locking cross piece locking said opposing hinge arms in an open position.

16. A mobile airborne contamination control system comprising:

a ventilation unit having at least one exhaust fan;

a filter assembly housed within said ventilation unit; and, a retractable contamination control booth including:

a longitudinally retractable/extendable frame having at least three pairs of opposing of risers, each said riser having a supporting rolling means, wherein each riser in each of said pair of opposing risers is hingeably attached to each adjacent riser;

at least three joists, each one of said at least three joists attached to one pair of said at least three pairs of opposing risers;

a cover of flexible material draped over all of said opposing risers and joists and thereby covering said retractable frame to form said booth having an enclosed work area;

a flexible rear wall attached to said retractable/extendable frame and sealingly attached to said ventilation unit around said filter assembly, wherein said filter assembly opens into said retractable booth from said rear wall; and, a front wall of said booth having at least one front door, each of said at least one door having a section permeable to air flow;

wherein said permeable section includes air intake filters; and, wherein said cover of said mobile airborne contamination control system is configured to be draped over the exterior of said frame in said longitudinally retracted condition;

wherein said filter assembly includes in order:

a first stage including a first dust filter capable of holding particles having a size of at least 0.62 microns;

a second stage including a second dust filter, said second dust filter comprising: nonshedding organic synthetic filters;

a third stage including a first activated charcoal filter;

a fourth stage including a pair of UV light sanitizers; and, a fifth stage including a second activated charcoal filter.

* * * * *